US006374151B1

(12) United States Patent
Amano et al.

(10) Patent No.: US 6,374,151 B1
(45) Date of Patent: Apr. 16, 2002

(54) QUILT DESIGNING METHOD AND APPARATUS

(75) Inventors: Michiyo Amano, Gifu; Takeshi Kawaguchi, Konan, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/570,431

(22) Filed: May 12, 2000

Related U.S. Application Data

(63) Continuation-in-part of application No. 09/514,585, filed on Feb. 28, 2000, now Pat. No. 6,295,480.

(30) Foreign Application Priority Data

May 12, 1999 (JP) ..... 11-131425

(51) Int. Cl.[7] ..... G06F 19/00; D05B 11/00

(52) U.S. Cl. ..... 700/133; 700/138; 112/117; 112/475.08

(58) Field of Search ..... 700/131, 132, 700/133, 136, 137, 138; 112/117, 118, 119, 102.5, 475.08

(56) References Cited

U.S. PATENT DOCUMENTS 5,095,835 A * 3/1992 Jernigan et al. ..... 112/119 X
5,826,526 A * 10/1998 Tomita ..... 700/138 X
6,026,756 A * 2/2000 Frazer et al. ..... 112/118

* cited by examiner

*Primary Examiner*—Peter Nerbun
(74) *Attorney, Agent, or Firm*—Oliff & Berridge, PLC

(57) ABSTRACT

It is determined whether a quilt design is applicable to paper piecing by determining whether all pieces of the quilt design are finally separated by separating each piece one after another by one straight demarcation line. When it is determined that the quilt design is applicable to paper piecing, demarcation lines that do not intersect other demarcation lines and that divide the quilt design into two blocks that each include a plurality of the pieces are selected. The quilt design is modified by extending the arbitrarily selected demarcation line, and deleting all demarcation lines that exist in one of blocks divided by the extended demarcation line.

11 Claims, 21 Drawing Sheets

| | |
|---|---|
| S1 | SPECIFY QUILT DESIGN |
| S2 | STORE QUILT DESIGN DATA |
| S3 | DEMARCATION LINE ANALYSIS PROCESSING |
| S4 | DESIGN SEPARABLE BY PIECE? |
| S5 | SEPARATE ONE PIECE |
| S6 | UPDATE QUILT DESIGN DATA |
| S7 | DEMARCATION LINE EXIST? |
| S8 | INDICATE APPLICABILITY OF QUILT DESIGN |
| S9 | DEMARCATION LINE SELECTION PROCESSING |
| S10 | DISPLAY MODIFIED QUILT DESIGN |
| S11 | SELECT MODIFIED QUILT DESIGN |
| S12 | UPDATE QUILT DESIGN |

[Flower]

| | X COORDINATE | Y COORDINATE | FLAG ON PERIPHERY |
|---|---|---|---|
| A | x a | y a | T |
| B | x b | y b | T |
| C | x c | y c | T |
| D | x d | y d | T |
| E | x e | y e | T |
| F | x f | y f | T |
| G | x g | y g | T |
| H | x h | y h | T |
| J | x j | y j | F |

Fig.7

| | A | B | C | D | E | F | G | H | J |
|---|---|---|---|---|---|---|---|---|---|
| A | | ○ | × | × | × | × | × | ○ | ○ |
| B | ○ | | ○ | × | × | ○ | × | × | × |
| C | × | ○ | | ○ | ○ | × | × | × | × |
| D | × | × | ○ | | ○ | × | × | × | × |
| E | × | × | ○ | ○ | | ○ | × | × | × |
| F | × | ○ | × | × | ○ | | ○ | × | × |
| G | × | × | × | × | × | ○ | | ○ | ○ |
| H | ○ | × | × | × | × | × | ○ | | ○ |
| J | ○ | × | × | × | × | × | ○ | ○ | |

Fig. 8B

| | |
|---|---|
| S1 | SPECIFY QUILT DESIGN |
| S2 | STORE QUILT DESIGN DATA |
| S3 | DEMARCATION LINE ANALYSIS PROCESSING |
| S4 | DESIGN SEPARABLE BY PIECE? |
| S5 | SEPARATE ONE PIECE |
| S6 | UPDATE QUILT DESIGN DATA |
| S7 | DEMARCATION LINE EXIST? |
| S8 | INDICATE APPLICABILITY OF QUILT DESIGN |
| S9 | DEMARCATION LINE SELECTION PROCESSING |
| S10 | DISPLAY MODIFIED QUILT DESIGN |
| S11 | SELECT MODIFIED QUILT DESIGN |
| S12 | UPDATE QUILT DESIGN |

Fig. 9B

DEMARCATION LINE ANALYSIS PROCESSING

| | |
|---|---|
| S21 | MAKE COLLECTION Lp THAT INCLUDES ELEMENTS WHOSE BOTH VERTEXES ARE NOT ADJACENT TO EACH OTHER ON PERIPHERY |
| S22 | MAKE COLLECTION Ls THAT INCLUDES ELEMENTS WHOSE BOTH VERTEXES ARE ON PERIPHERY |
| S23 | MAKE COLLECTION Li THAT INCLUDES ELEMENTS THAT ARE OBTAINED BY ELIMINATING ELEMENTS OF COLLECTION Ls FROM ELEMENTS OF COLLECTION Lp |
| S24 | SELECT VERTEX LIST WHOSE ONE OF VERTEXES ON PERIPHERY FROM COLLECTION Li |
| S25 | SELECT ELEMENT THAT STRAIGHTLY CONNECTS TO SELECTED ELEMENT |
| S26 | ONE OF VERTEXES REACHED PERIPHERY? |
| S27 | ADD ELEMENT THAT INCLUDES VERTEX WHICH REACHED PERIPHERY BY STRAIGHTLY CONNECTING TO SELECTED VERTEX TO COLLECTION Lm |
| S28 | ELEMENT WHOSE ONE OF VERTEXES IS ON PERIPHERY LEFT? |

Fig.10 A
$L_D = \{ (A, J), (B, F), (C, E), (G, J), (H, J) \}$
$L_S = \{ (B, F), (C, E) \}$
$L_i = \{ (A, J), (G, J), (H, J) \}$
Fig.10 B
$L_i = \{ (H, J) \}$
$L_m = \{ (A, J, G) \}$
Fig.11 A
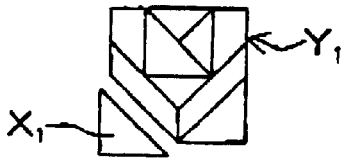
Fig.11 B
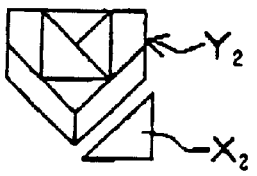

Fig. 12B

DEMARCATION LINE SELECTION PROCESSING

| | |
|---|---|
| S31 | SELECT DEMARCATION LINE THAT DOES NOT INTERSECT OTHER DEMARCATION LINES EVEN WHEN IT IS EXTENDED TO PERIPHERY |
| S32 | STORE SELECTED DEMARCATION LINE DATA |

Fig.16 A
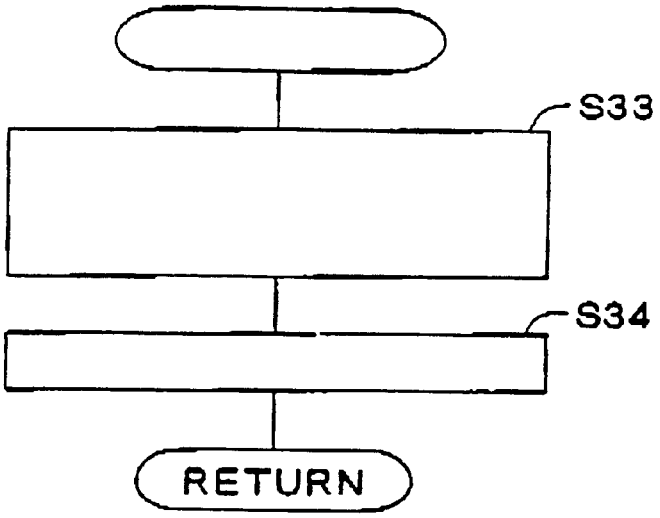
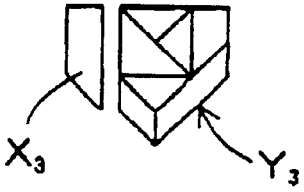
FIG 17A
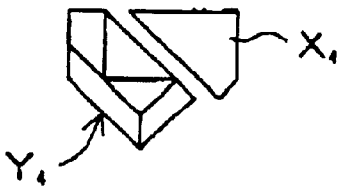
FIG 17B
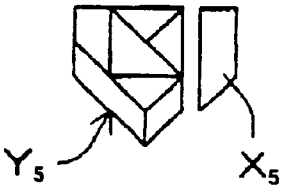
FIG. 17C

Fig. 16B

DEMARCATION LINE SELECTION PROCESSING

| | |
|---|---|
| S33 | SELECT DEMARCATION LINE THAT DOES NOT INTERSECT OTHER DEMARCATION LINES EVEN WHEN IT IS EXTENDED TO PERIPHERY AND THAT DIVIDES QUILT DESIGN SO THAT NUMBER OF DEMARCATION LINES, WHICH EXIST IN ONE OF BLOCKS DIVIDED BY EXTENDED DEMARCATION LINE, IS LESS THAN 2 |
| S34 | STORE SELECTED DEMARCATION LINE |

Fig. 18B

| | |
|---|---|
| S1 | SPECIFY QUILT DESIGN |
| S2 | STORE QUILT DESIGN DATA |
| S3 | DEMARCATION LINE ANALYSIS PROCESSING |
| S4 | DESIGN SEPARABLE BY PIECE? |
| S5 | SEPARATE ONE PIECE |
| S6 | UPDATE QUILT DESIGN DATA |
| S7 | DEMARCATION LINE EXIST? |
| S8 | INDICATE APPLICABILITY OF QUILT DESIGN |
| S13 | DEMARCATION LINE SELECTION PROCESSING |
| S14 | INDICATE MODIFIED QUILT DESIGN |

Fig. 19B

DEMARCATION LINE SELECTION PROCESSING

| | |
|---|---|
| S33 | SELECT DEMARCATION LINE THAT DOES NOT INTERSECT OTHER DEMARCATION LINES EVEN WHEN THEY ARE EXTENDED TO PERIPHERY AND THAT DIVIDES QUILT DESIGN SO THAT NUMBER OF DEMARCATION LINES, WHICH EXIST IN ONE OF BLOCKS DIVIDED BY EXTENDED DEMARCATION LINE, IS LESS THAN 2 |
| S34 | STORE SELECTED DEMARCATION LINE |
| S35 | UNCONFIRMED SELECTED DEMARCATION LINE LAST? |
| S36 | PERFORM SIMULATION OF SEPARATION BY PIECE ACCORDING TO QUILT DESIGN THAT IS MODIFIED BY EXTENDING SELECTED DEMARCATION LINE TO BE DETERMINED |
| S37 | QUILT DESIGN SEPARABLE TILL THE LAST? |
| S38 | DELETE STORED SELECTED DEMARCATION LINE DATA |

[Fish]

[Flower]

QUILT DESIGNING METHOD AND APPARATUS

This application is a continuation-in-part of U.S. patent application Ser. No. 09/514,585, filed Feb. 28, 2000, U.S. Pat. No. 6,295,480 the entire disclosure of which is incorporated into this application by reference.

BACKGROUND OF THE INVENTION

1. Field of the Invention

The present invention relates to a quilt designing method, and an apparatus for designing a quilt, that is applicable to a piecing method, known as a paper piecing, wherein patches of arbitrary size are stitched on thin paper on which a quilt design is drawn.

2. Description of the Related Art

To make a quilt, first, a quilt design is made based on photographs or patterns. Next, patches, called pieces, which are suitable for forming a quilt design, are pieced together one by one using a sewing machine.

Recently, a piecing method, known as paper piecing (also known as a paper foundation piecing), has become widespread. In accordance with this method, a quilt design is printed on thin paper, and arbitrary sized fabrics are stitched on the thin paper using the sewing machine according to a piecing order. According to this method, once the thin paper, which operates a foundation on which a quilt design with piecing order is printed, is prepared, it is not necessary to mark on a fabric or to cut the fabric to a suitable size for the foundation. Therefore, a desirable quilt can be made extremely easily, and can be beautifully made even though the pieces are small, using the method described above.

However, paper piecing is not applicable to all quilt designs, because the method repeats stitching on only one side of a piece on a foundation with straight stitches using a sewing machine. Therefore, a quilt design that is not applicable to paper piecing needs to be modified so as to become applicable to paper piecing.

For example, a quilt design "Fish", which is a modification of fish, shown in FIG. 21, and a quilt design "Flower", which is a modification of flower, shown in FIG. 22A, are determined as to whether they are applicable to paper piecing. The quilt design "Fish" can be made by piecing pieces together, following a piecing order given to pieces printed on a foundation, as shown in FIG. 21, so that it is applicable to paper piecing. On the other hand, in the quilt design "Flower", a portion of which is a stem, cannot be stitched by the paper piecing that is the method for piecing pieces one by one using a sewing machine, so that it is not applicable to paper piecing. Therefore, the stem portion of the quilt design "Flower" needs to be modified. By changing the shape of the piece to a shape shown in FIGS. 22B or 22C, the pieces of the quilt design "Flower" becomes possible to be pieced together, following the piecing order given to the pieces printed on a foundation.

As described above, only the person who has the requisite skill and determination can design quilts by determining whether the quilt design is applicable to paper piecing, and if not, determining how the quilt design should be modified so as to be applicable to paper piecing. At present, experienced designers having the requisite skill can design the quilts for paper piecing. Novice quilters make quilts using the existing quilt designs.

Similar to other fields, in the quilt field, quilters who want to make quilts based on one's own quilt designs have increased in number. However, as described above, everyone cannot design quilts because a certain amount of skill for designing quilts is required. Therefore, it is difficult for the quilters to design their own quilts.

Further, even a person who has experience in designing quilts finds it difficult to determine whether a complicated quilt design is applicable to paper piecing. Particularly, it is difficult to modify the quilt design so as to become applicable to paper piecing, without departing from the original quilt design, due to mistakes, such as oversight.

SUMMARY OF THE INVENTION

It is an object of the invention to provide a quilt designing method and an apparatus for easily designing a quilt that is applicable to paper piecing for not only skilled designers, but also novice quilters who have no experience in designing quilts.

In order to achieve the above and other objects, a quilt designing method comprises the steps of determining whether a quilt design is applicable to a predetermined piecing method for making a quilt based on quilt design data showing the quilt design that includes a plurality of pieces, and modifying the quilt design so that the quilt design becomes applicable to the predetermined piecing method when the quilt design is determined as not being applicable to the predetermined piecing method in the determining step.

According to the quilt designing method described above, it is automatically determined whether the quilt design is applicable to the predetermined piecing method. A quilt design that is not applicable to the predetermined piecing method is automatically modified so as to be applicable to the predetermined piecing method. Therefore, the quilt design that is applicable to the predetermined piecing method can be obtained without having special knowledge of quiltmaking.

In another aspect of the invention, the step of determining the quilt design can including determining whether all pieces of the quilt design are eventually separated from the quilt design by separating the pieces one after another by one straight demarcation line. Therefore, it can be efficiently and assuredly determined whether the quilt design is applicable to the predetermined piecing method.

In another aspect of the invention, the step of determining the quilt design can include determining whether the quilt design is applicable to the predetermined piecing method when the quilt design is divided into two blocks, that each include a plurality of the pieces, by one straight demarcation line, even when the quilt design cannot be separated into pieces by one straight demarcation line. Therefore, the number of modifications of the quilt design can be minimized.

In another aspect of the invention, the step of determining the quilt design can include analyzing a property of demarcation line separating adjacent pieces based on the quilt design data. Therefore, a simulation, such that each piece is separated from the quilt design one after another by one straight demarcation line, can be efficiently performed.

According to another aspect of the invention, the step of modifying the quilt design can include selecting demarcation lines that do not intersect other demarcation lines even when the demarcation lines are extended to a periphery, and that divides the quilt design into two blocks, that includes a plurality of the pieces, and the step of modifying the quilt design can extend the demarcation lines, which is arbitrarily selected by the step of selecting the demarcation line, and can modify the quilt design by deleting all demarcation lines that exist in one of the blocks divided by the extended demarcation line. Therefore, the quilt design can be certainly and efficiently modified so as to be applicable to the predetermined piecing method.

According to another aspect of the invention, the step of selecting the demarcation lines can include selecting demarcation lines that divide the quilt design so that a number of the demarcation lines, which exist in one of blocks divided by the demarcation line and which are to be deleted by the step of modifying the quilt design, is a predetermined number or less. Therefore, a modification, that makes the quilt design depart from the original quilt design, can be efficiently prevented.

In another aspect of the invention, the step of selecting the demarcation line can include selecting a demarcation line that divides the quilt design, so that the quilt design cannot become unseparable again, and predicting a separating situation after the division. Therefore, the quilt design can be efficiently modified without repeating the modification.

In another aspect of the invention, the step of modifying the quilt design can include selecting, with a demarcation line selector, demarcation lines that do not intersect other demarcation lines, even when the demarcation lines are extended to a periphery, and dividing the quilt design into two blocks that include a plurality of the pieces, and the step of modifying the quilt design can include modifying the quilt design by extending the demarcation lines, which are arbitrarily selected by the step of selecting the demarcation line, to the periphery. Therefore, the number of modifications of the quilt design can be minimized, so that the quilt design can be modified to a quilt design that is similar to the original.

In another aspect of the invention, in the method described above, the step of selecting the demarcation line can include selecting a demarcation line that divides the quilt design, so that the quilt design cannot become unseparable again, and predicting a separating situation after the division. Therefore, the quilt design can be efficiently modified without repeating the modification. Therefore, the quilt design can be efficiently modified without repeating the modification.

BRIEF DESCRIPTION OF THE DRAWINGS

A preferred embodiment of the present invention will be described in detail with reference to the following figures wherein:

FIG. 7 is a diagram conceptually showing a matrix of vertex connection of the design data to be used in the quilt designing apparatus;

FIGS. 10A and 10B are diagrams showing examples of collections of demarcation lines obtained by the demarcation line analysis processing;

FIGS. 11A and 11B are diagrams each showing a step of separating a piece from a quilt design "Flower";

FIG. 16A is a flowchart showing demarcation line selection processing executed by a quilt designing apparatus of another embodiment, and FIG. 16B includes a summarized description of each step of the flowchart of FIG. 16A;

FIGS. 17A through 17C are diagrams each showing a step of separating a piece from the quilt design "Flower" after modification;

DETAILED DESCRIPTION OF THE PREFERRED EMBODIMENTS

Figure 1:
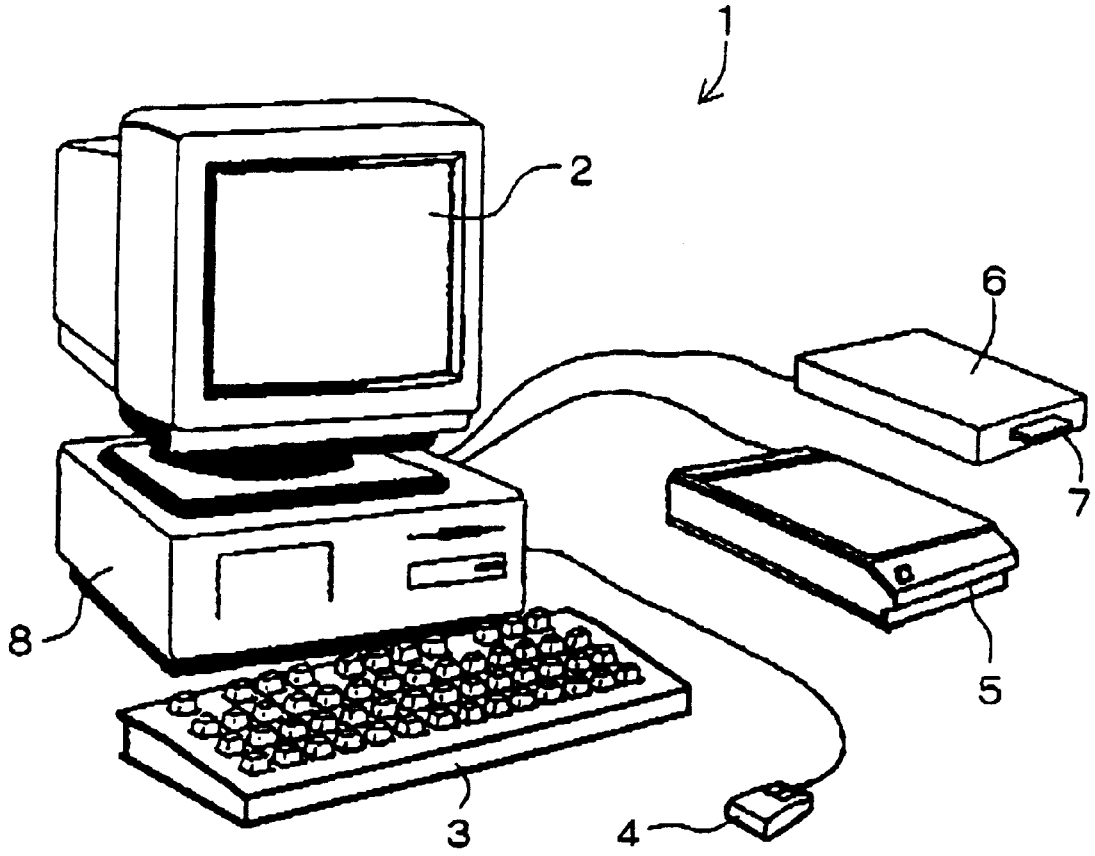
FIG. 1 is a perspective view showing an embodiment of a quilt designing apparatus according to the invention.

Embodiments of the invention will be described with reference to the accompanying drawings. As shown in FIG. 1, a quilt designing apparatus 1 includes a CRT display 2 capable of basically displaying image data, such as quilt designs, a keyboard 3, a coordinate input device (i.e. mouse) 4, an image reader 5, such as a color image reader, a flash memory device 6 that a RAM card 7 can be inserted into and withdrawn from, and a main control unit 8 that controls these elements.

Figure 2:
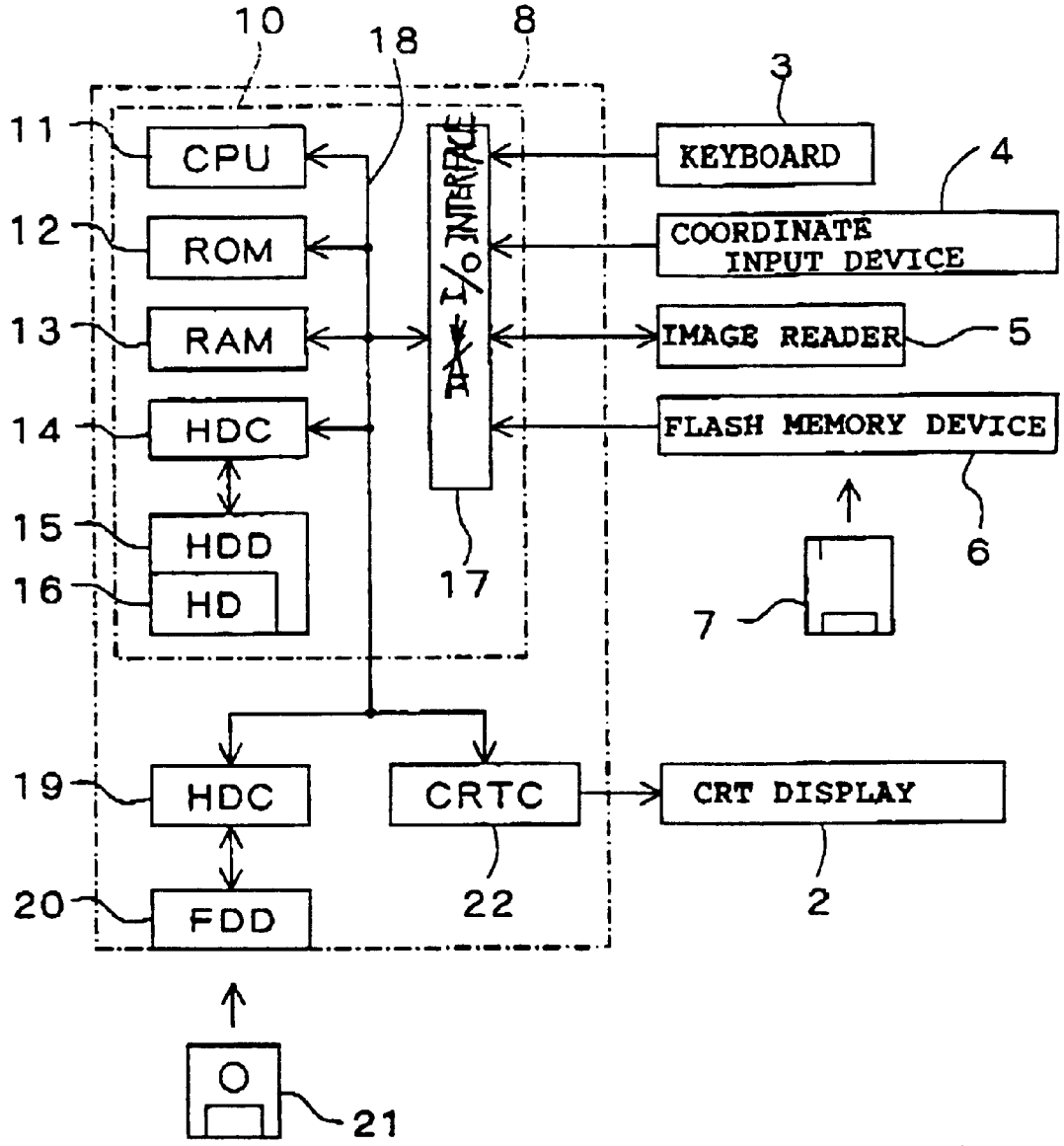
FIG. 2 is a block diagram showing controlling systems of the quilt designing apparatus.

FIG. 2 is a block diagram showing controlling systems of the quilt designing apparatus 1. A control device 10 disposed in the main control unit 8 comprises a CPU 11, a ROM 12 and a RAM 13 that are connected to the CPU 11 via a bus 18 such as data bus, a hard disk controller (HDC) 14 that controls a hard disk drive (HDD) 15 having a hard disk (HD) 16, and an I/O interface 17. The keyboard 3, the coordinate input device 4, the image reader 5, and the flash memory device 6 are connected to the I/O interface 17.

A floppy disk controller (FDC) 19 and a CRT display controller (CRTC) 22 are connected to the bus 18. The floppy disk controller 19 controls a floppy disk drive (FDD) 20 detachably mounting a floppy disk 21, and the CRT display controller 22 outputs display data to the CRT display 2.

As with a general host computer, a startup program that boots the quilt designing apparatus 1 when power is turned on, is stored in the ROM 12. The HD 16 stores various operating systems (OS), such as MS-DOS or Windows System, various drivers and software, which enable the CRT display 2, the keyboard 3, the coordinate input device 4, the image reader 5, and the flash memory device 6 on the system, and various application programs, such as image forming software and image modifying software. Further, a control program that controls a modification of quilt design is stored in the HD 16.

Therefore, to execute various application programs, not only the OSs, such as MS-DOS stored in the HD 16, but also the application programs, such as a word processing program, the image forming software, the image modifying software, and the control program for quilt design modification, are read as necessary, and each memory (ex. the RAM 13, the HD 16, and the FD 21) is used as needed.

Figure 3:
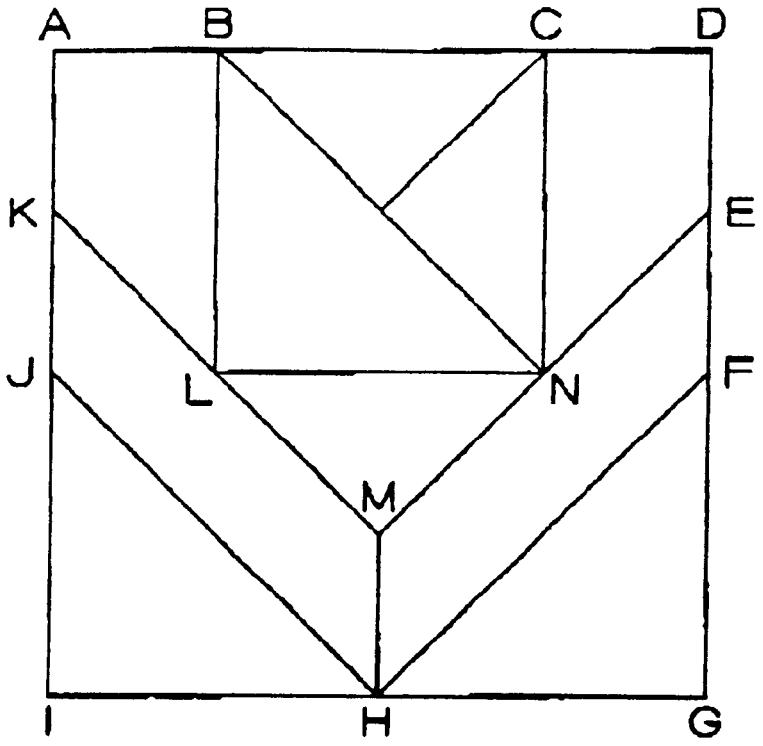
FIG. 3 is a diagram showing an example of a quilt design with constructing symbols that show areas.

Further, quilt design data memory provided in the HD 16 stores quilt design data showing each arrangement of a plurality of pieces for various types of quilt designs, including the quilt design "Flower" shown in FIG. 3, as discussed below. For example, the quilt design data of the quilt design "Flower" includes ten pieces, such as a piece ABLK, and a piece BNL. In the quilt design data memory, data about a periphery ABCDEFGHIJK, and line segments, BL and KM, which are demarcation lines of each piece, are stored.

Figure 4:
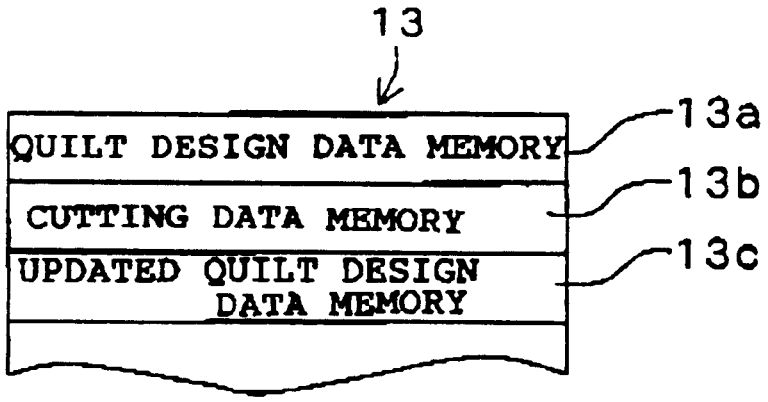
FIG. 4 is a diagram conceptually showing a memory structure of a RAM of a control device in the quilt designing apparatus.

As shown in FIG. 4, allocated in the ROM 13 are quilt design data memory 13*a* that reads quilt design data showing a desirable quilt design, which is selected by operating the mouse 4, from the HD 16 and stores it, cutting data memory 13*b* that stores quilt design cutting data, and updated quilt design data memory 13*c* that stores updated quilt design data.

Figures 5, 6:
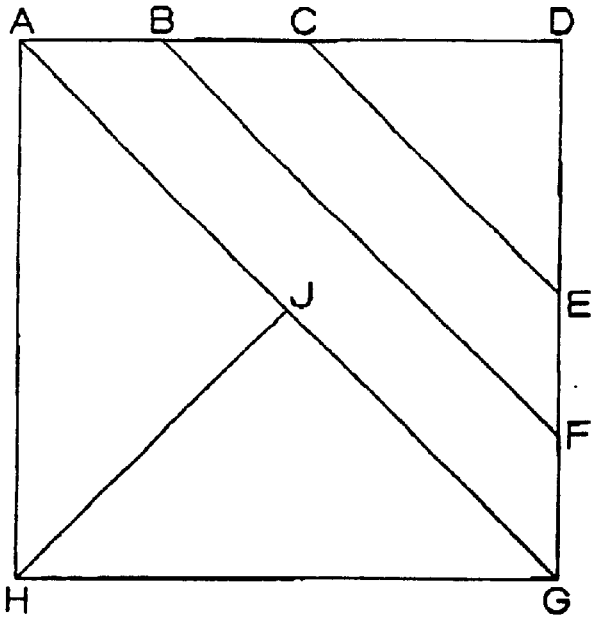
FIG. 5 is a diagram showing an example of a quilt design to be used for an explanation of demarcation line analysis processing executed by the quilt designing apparatus.
FIG. 6 is a diagram conceptually showing a vertex information list of design data to be used in the quilt designing apparatus.

The quilt design data memory 13*a* stores the quilt design data that includes a vertex information list and a matrix of vertex connection. The vertex information list includes vertex symbols, position coordinates of each vertex, and flags on periphery that identify whether a vertex is on a periphery, with respect to each vertex forming a quilt design. The arrangement order of vertexes in the vertex information list is that a vertex which is on a periphery of a quilt design is an upper position and other vertex (hereinafter referred to as an inside vertex) is a lower position. The matrix of connection of vertexes shows a connection between each vertex. The vertexes on a periphery of a quilt design are provided with symbols clockwise from any vertex along the periphery. As the data is structured as such, the positional relationship of two vertexes on the periphery can be determined by comparing data on the matrix of the connection of vertexes. FIG. 5 shows an example of a quilt design. The vertex information list and the matrix of connection of the vertexes that corresponds to the quilt design of FIG. 5 are shown in FIGS. 6 and 7, respectively.

In the vertex information list, for example, as shown in FIG. 5, all vertexes A through H are on the periphery, so that the flag on the periphery T is recorded and the vertex J is not on the periphery, so that the flag on the periphery F is recorded.

In the matrix of vertexes connection, O means that the vertexes form a line segment, and X means that the vertexes do not form a line segment. However, when there is another vertex between vertexes, X is indicated because the line segments overlap each other.

For example, as shown in FIG. 5, the vertexes A and B form a line segment, so that O is indicated. Between the vertexes A and C, there is the vertex B, so that X is indicated in the matrix of connection of vertexes shown in FIG. 7.

Figure 8A:
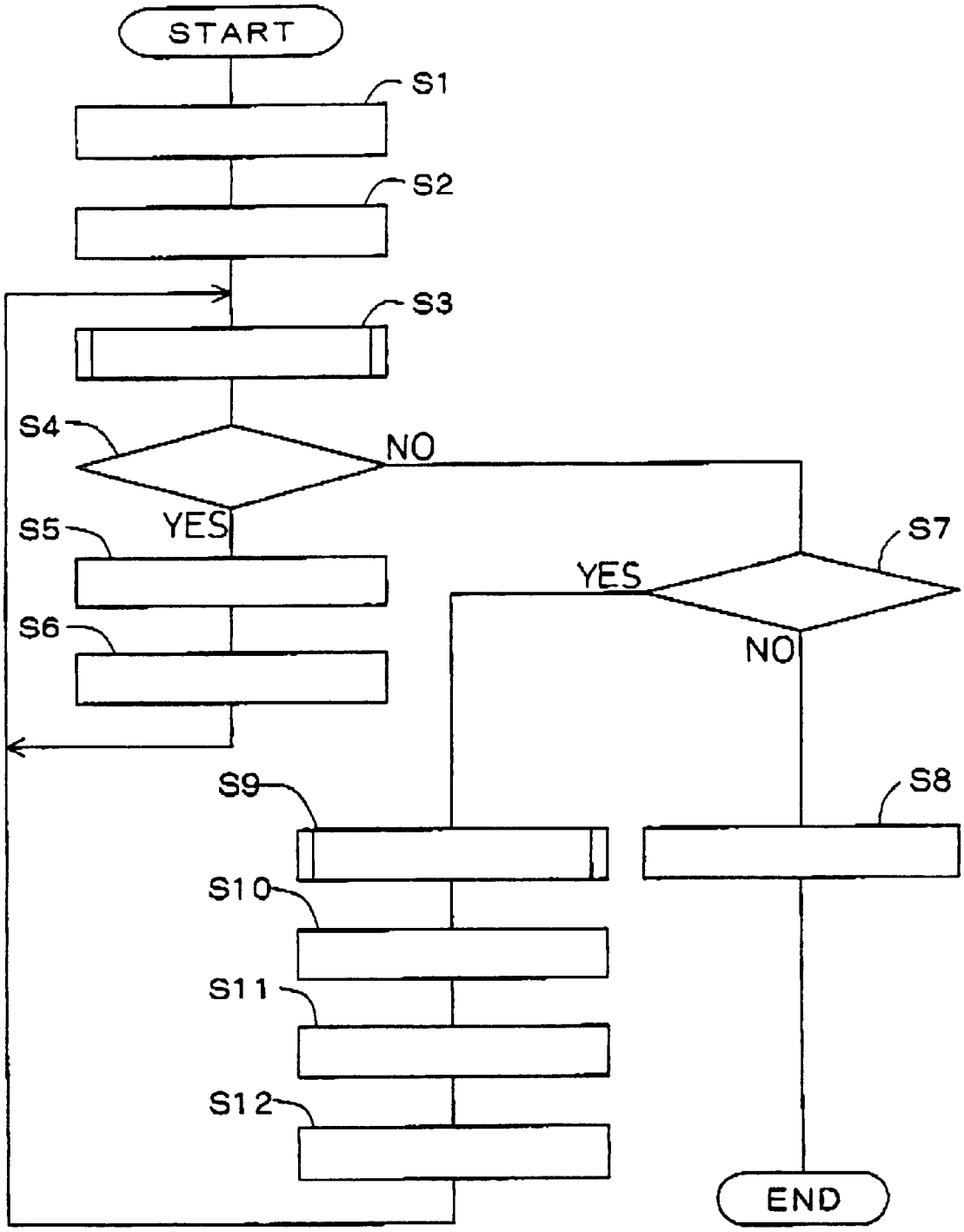
FIG. 8A is a flowchart showing whole processing executed by the quilt designing apparatus, and FIG. 8B includes a summarized description of each step of the flowchart of FIG. 8A.

Next, the control for a modification of a quilt design performed in the control device 10 of the quilt designing apparatus 1 will be described with reference to a flowchart shown in FIG. 8A. A summarized description of each step of the flowchart of FIG. 8A is provided in FIG. 8B. In the figures, Si (i=1, 2, 3, . . . ) stands for each step. First, a quilt design selection screen that selects one desirable quilt design from a plurality of quilt designs, which is stored in the quilt design data memory of the HD 16, is displayed on the CRT display 2. As one desirable quilt design is specified using the keyboard 3 or the mouse 4 (S1), quilt design data of the specified quilt design is stored in the quilt design data memory 13*a* and the updated quilt design data memory 13*c* in the RAM 13 (S2).

Figure 9A:
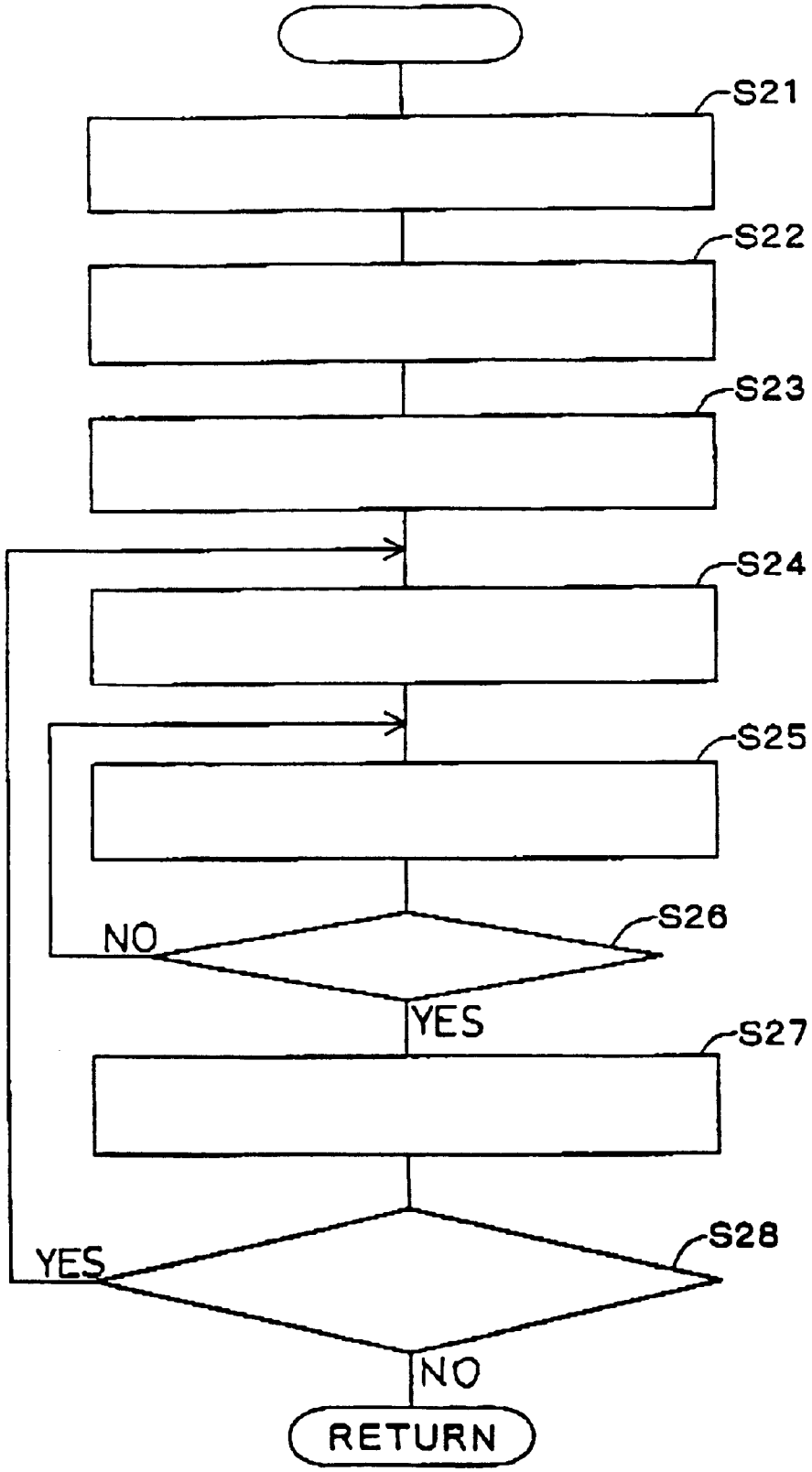
FIG. 9A is a flowchart showing the demarcation line analysis processing executed by the quilt designing apparatus, and FIG. 9B includes a summarized description of each step of the flowchart of FIG. 9A.

Next, based on the quilt design data corresponding to the specified quilt design, demarcation line analysis processing that analyzes a property of a demarcation line separating adjacent pieces is executed (S3). The demarcation line analysis processing (S3) will be described in detail with reference to a flowchart shown in FIG. 9A. A summarized description of each step of the flowchart of FIG. 9A is provided in FIG. 9B.

First, pairs of vertexes that are not adjacent to each other on the periphery are selected from pairs of vertexes that are connected in the matrix of connection of vertexes described above, and a collection Lp that includes elements which are the selected pairs of vertexes is made (S21). After that, elements whose both vertexes are on the periphery are selected from the elements in the collection Lp and a collection Ls is made (S22). Then, a collection Li that includes elements which are obtained by subtracting the collection Ls from the collection Lp (S23). The collection Ls is a collection of demarcation lines which straightly divides the quilt design into two blocks without passing the inside vertex. The collection Li includes elements whose at least one of vertexes is the inside vertex.

Next, an element t1, whose vertex is a vertex p1 on the periphery, is selected from the list Li (S24). Then, an element t2 whose one vertex is a vertex p2, which is the selected other vertex of the element, and which the vertexes p1, p2, and p3 are in the straight line when the other vertex is determined as the vertex p3, is selected (S25). The elements t1 and t2 under such a relationship form each line segment that is straightly connected with each other.

Here, the determination as to whether one of the vertexes of the selected element ti has reached the periphery is performed (S26). When the vertex pi has not reached the periphery yet, the processing is returned to S25, and an element t3 that straightly connects to the selected element t2 is selected at S25. After that, the selection of an element ti is repeated until an element pi, which is one of vertexes of the selected element, reaches the periphery. On the other hand, at S26, when the vertex pi has reached the periphery, the elements t1 through ti are excerpted from the collection Li, elements that include the vertexes p1 through pi are made and are added to a collection Lm (S27).

When the element, whose one of the vertexes is on the periphery, exists in the collection Li (S28-Y), the processing is returned to S24 and a string of the selection processing is repeated. When a string of the processing as to all elements, whose one of the vertexes in on the periphery, is completed, and the collection Lm of the elements showing a demarcation line that straightly divides a quilt design into two blocks by passing the inside vertex is brought into completion (S28-N), the demarcation line analysis processing is finished.

By executing the processing described above, a collection of the elements showing the demarcation line, that divides the quilt design, is a sum of the collections Ls and Lm. A first vertex and a last vertex of the obtained element exist on the periphery, and they are endpoints of a plurality of continuous vertexes, so that the element is a demarcation line that can separate a piece from a quilt design.

Contents of the collections Lp, Ls, and Li of the elements after the above-described demarcation line analysis processing is executed on the quilt design shown in FIG. 5 by S23 is shown in FIG. 10A. The collections Li and Lm after the demarcation line analysis processing is completed is shown in FIG. 10B.

As the properties of the demarcation lines separating adjacent pieces are analyzed (S3), it is determined whether each piece of the quilt design can be separated by one straight demarcation line (S4). That is, the determination is performed as to whether a demarcation line, which crosses the quilt design and which separates a piece from the quilt design so that the separated piece will not have a demarcation line, exists. For example, in the quilt design "Flower" shown in FIG. 3, pieces HIJ and FGH can be separated by demarcation lines JH and FH, respectively, so that the quilt design "Flower" is determined such that it is separable.

When it is determined that the quilt design is separable (S4-Y), any one piece is separated from the specified design (S5), the quilt design data is updated so as to correspond to the quilt design whose one piece has been separated, and the updated quilt design data is stored in the updated quilt design data memory 13*c* in the RAM 13 (S6). For example, in the quilt design "Flower", as shown in FIG. 11A, quilt design data corresponding to a quilt design Y1, from which a piece X1 has been separated, is stored in the updated quilt design data memory 13*c*.

Then, the processing is returned to S3, and a string of the processing is repeated until pieces cannot be separated from the quilt design, as the updated quilt design is determined as a new object to be determined. For example, in the quilt design "Flower", as shown in FIG. 11B, when a piece X2 is separated from the quilt design "Flower", a piece cannot be separated from a quilt design Y2 any more by one demarcation line.

On the other hand, when it is determined that the quilt design is unseparable (S4-N), the quilt design is determined as to whether demarcation lines exist in the quilt design that is an object to be determined (S7). When there is no demarcation line left, it means that all pieces forming the quilt design are separated. Therefore, the first specified quilt design and information that the quilt design is applicable to the paper piecing are displayed on the CRT display 2 (S8), and the processing is finished.

Figure 12A:
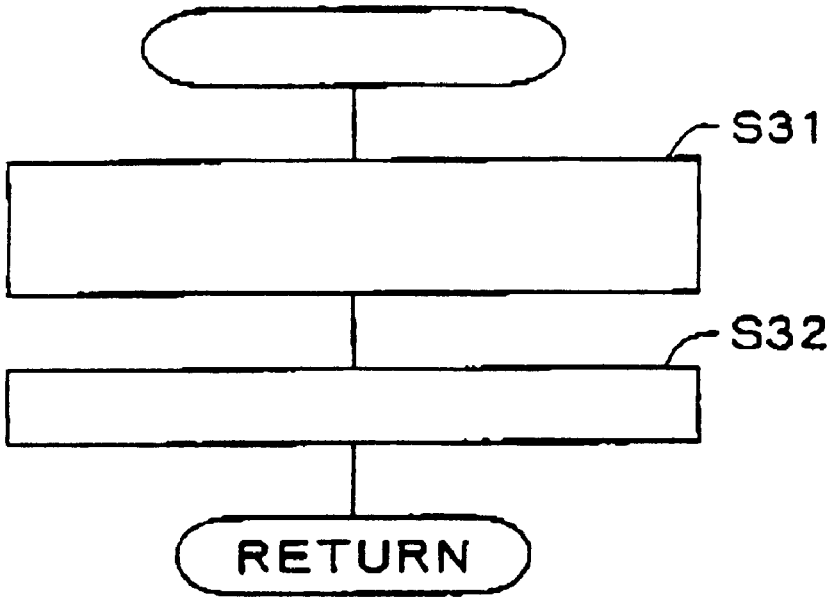
FIG. 12A is a flowchart showing demarcation line selection processing executed by the quilt designing apparatus, and FIG. 12B includes a summarized description of each step of the flowchart of FIG. 12A.
Figure 13:
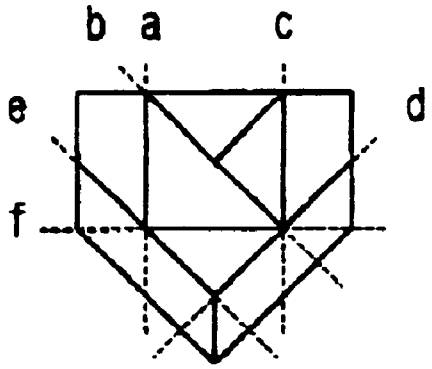
FIG. 13 is a diagram showing demarcation lines which are selected at the demarcation line selection processing to modify the quilt design "Flower"

On the other hand, at S7, when the demarcation line exists, it means that all pieces forming the quilt design cannot be separated, so that the processing is moved to quilt design modifying processing, and first, the demarcation line selection processing is executed (S9). At the demarcation line selection processing (S9), as shown in FIGS. 12A and 12B, a demarcation line that does not intersect other demarcation lines even when it is extended to the periphery is selected (S31), and demarcation line data of the selected demarcation line is stored in the cutting data memory 13*b* (S32). For example, in the quilt design "Flower", as shown in FIG. 13, six demarcation lines a through f are selected, and the demarcation line data of the six demarcation lines are stored in the cutting data memory 13*b*.

Figure 14A:
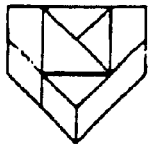
FIGS. 14A through 14F are diagrams showing the quilt designs "Flower" which are modified based on the demarcation lines selected at the demarcation line selection processing.
Figure 14B:
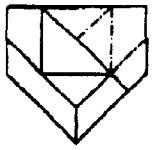
Figure 14C:
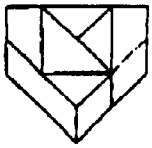
Figure 14D:
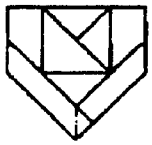
Figure 14E:
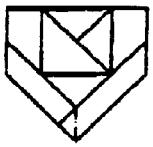

For example, in the quilt design "Flower", when the demarcation lines are selected as described above, as shown in FIGS. 14A through 14F, design images in which each demarcation line is extended are displayed on the CRT display 2 (S10), and an operator selects any design image (demarcation line) based on the quilt designs displayed on the CRT display 2 (S11). When any design image (demarcation line) is selected by the operator, the demarcation line is extended, and the quilt design is modified so that one piece can be separated at the extended demarcation line, by deleting all demarcation lines that exist in one of blocks divided by the extended demarcation line. The quilt design data stored in the updated quilt design data memory 13*c* is updated to the quilt design data corresponding to the updated quilt design (S12). Then, the processing is returned to S3 and a string of the quilt design determining processing is repeated. When the piece cannot be separated from the design any more (S4-N) and there is no demarcation line left in the quilt design (S7-N), the modified quilt design is displayed on the CRT display 2 (S8) and the demarcation line analysis processing is completed. For example, when the demarcation line d shown in FIG. 13 is selected for the quilt design "Flower", as shown in FIGS. 15A through 15G, all pieces can be separated and the quilt design data which is modified to the quilt design shown in FIG. 14E is displayed on the CRT display 2 as the quilt design that is applicable to the paper piecing.

In the embodiment of the invention, a quilt design determiner executes a string of the processes of S3 through S7, and a quilt design modifier executes a string of the processes of S9 through S12. The main control unit 8, that includes such elements as the control program that modifies a quilt design stored in the CPU 11, the ROM 12, the RAM 13, the HD 16, and the ROM 12 of the embodiment of the invention, function by the design determiner and the quilt design modifier.

As described above, the quilt designing apparatus 1 automatically determines whether the specified quilt design is applicable to paper piecing. When the specified quilt design is not applicable to paper piecing, the quilt designing apparatus 1 automatically modifies the quilt design so as to make the quilt design applicable to paper piecing. Therefore, not only experienced designers, but also novice quilters, who have no experience in designing quilts, can easily design quilts that are applicable to paper piecing.

Further, the quilt designing apparatus 1 determines whether the quilt design is applicable to paper piecing by determining whether all pieces can be separated finally by separating pieces one after another by one straight demarcation line. Therefore, determination results can be efficiently and certainly obtained.

Furthermore, the quilt designing apparatus 1 specifies a demarcation line that separates one piece from a quilt design in advance by the demarcation line analysis processing that analyzes the property of the demarcation line separating adjacent pieces, based on the quilt design data corresponding to the quilt design to be determined. Therefore, a separating simulation, such that each piece is separated from the quilt design one after another by each straight line at the time of the design determining processing, can be performed efficiently and in a short amount of time.

Moreover, when it is determined that the specified quilt design is not applicable to paper piecing, the quilt designing apparatus 1 selects a demarcation line that does not intersect other lines even when it is extended to the periphery and that divides the quilt design into two blocks that include a plurality of the pieces. The quilt designing apparatus 1 also modifies the quilt design so that one piece can be separated from the quilt design, by extending the arbitrarily selected demarcation line to the periphery and deleting all demarcation lines that exist in one of the blocks divided by the extended demarcation line. Therefore, the quilt design can be efficiently modified so as to be applicable to paper piecing.

Figure 14F:
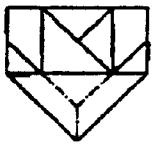
Figure 15A:
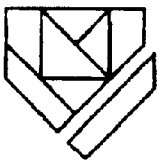
FIGS. 15A through 15G are diagrams each showing a step of separating a piece from the quilt design "Flower" after modification.
Figure 15B:
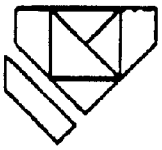
Figure 15C:
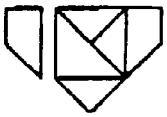
Figure 15D:
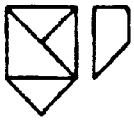
Figure 15E:
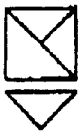
Figure 15F:
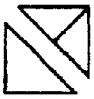
Figure 15G:
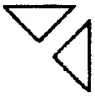

In the demarcation line selection processing at the time of modifying the quilt design, all demarcation lines that do not intersect other demarcation lines even when they are extended to the periphery are selected. However, in an embodiment of the invention, as shown in FIGS. 16A and 16B, demarcation lines that do not intersect other demarcation lines even when they are extended to the periphery and that divides the quilt design so that a number of the demarcation lines, which exist in one of blocks divided by the extended demarcation line, is less than a predetermined number, for example, less than 2, are selected (S33). The selected demarcation line data is stored in the cutting data memory 13*b* (S34), so that the demarcation lines are not deleted more than necessary. Therefore, the quilt design can be efficiently prevented from departing from the original quilt design at the time of modification. For example, in the quilt design "Flower", when the demarcation lines b and f are extended (see FIG. 13), three demarcation lines (indicated with a dot-dash line) will be deleted, as shown in FIGS. 14B and 14F. When the demarcation lines a, c, d, and e (see FIG. 13) are extended, one demarcation (shown with a dot-dash line) line will deleted from each quilt design, as shown in FIGS. 14A, 14C, 14D, and 14E. Therefore, when the number of the demarcation lines that exists in one of blocks divided by the extended demarcation line is set to 1 or less, four demarcation lines a, c, d, and e are selected.

Further, in the demarcation line selection processing at the time of modifying the quilt design, only demarcation lines that divide the quilt design so that the quilt design will not be unseparable again are selected, while predicting a separating situation after the division. Therefore, it is unnecessary to repeat the modification again and again, so that the modification can be efficiently performed. For example, in the quilt design "Flower", any one of the demarcation lines a, b, or c is selected from the six demarcation lines a through f (see FIG. 13) selected at the time of the first quilt design modifying processing, any piece cannot be separated from designs Y3, Y4, and Y5 after each piece X3, X4, and X5 is separated, respectively, as shown in FIGS. 17A, 17B, and 17C. Therefore, the quilt design has to be modified again at this stage. Consequently, the number of modifications is minimized by eliminating the demarcation lines, which causes such a situation, from a choice of the selection.

Figure 18A:
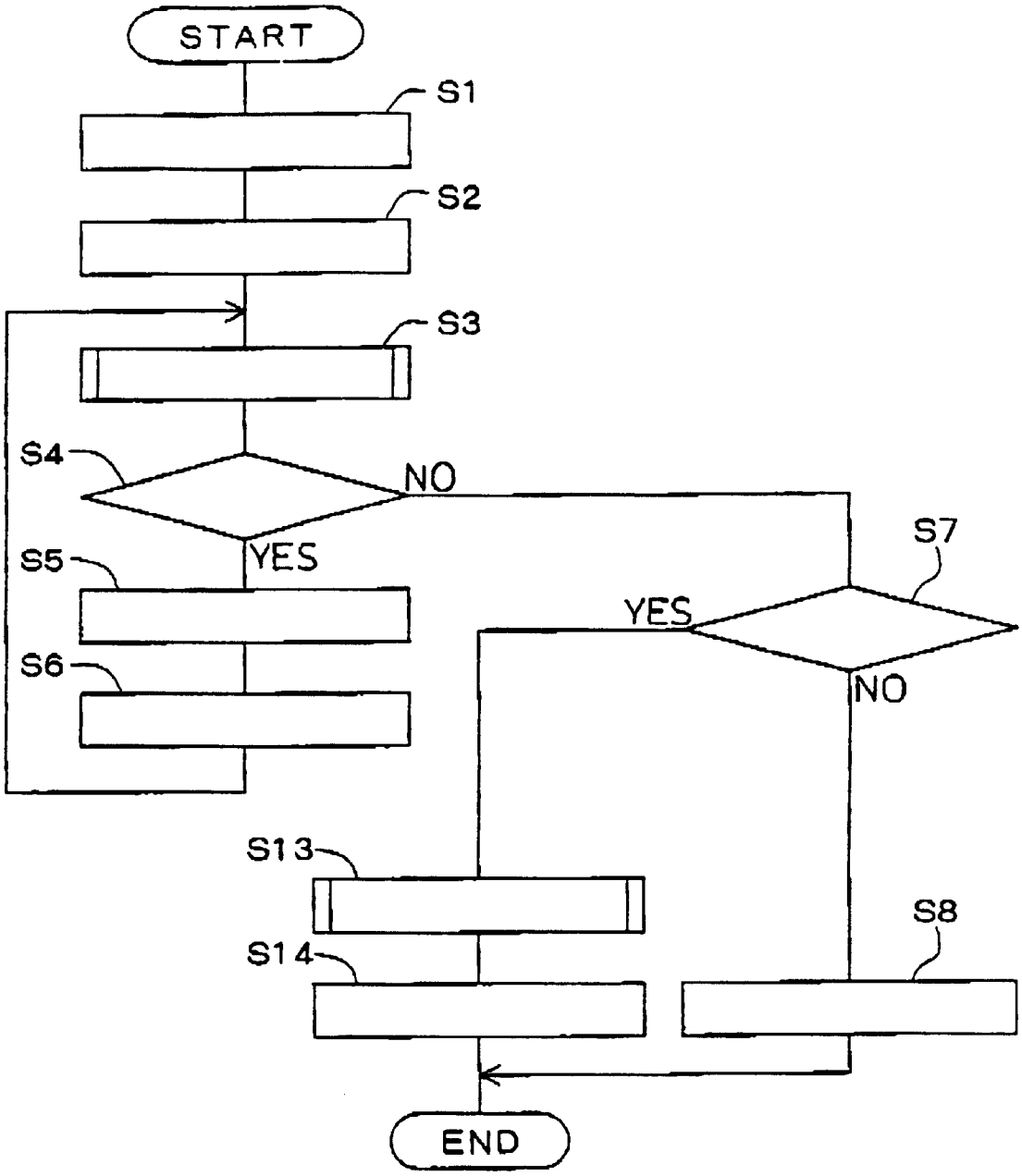
FIG. 18A is a flowchart showing whole processing executed by a quilt designing apparatus of other embodiment, and FIG. 18B includes a summarized description of each step of the flowchart of FIG. 18A.
Figure 19A:
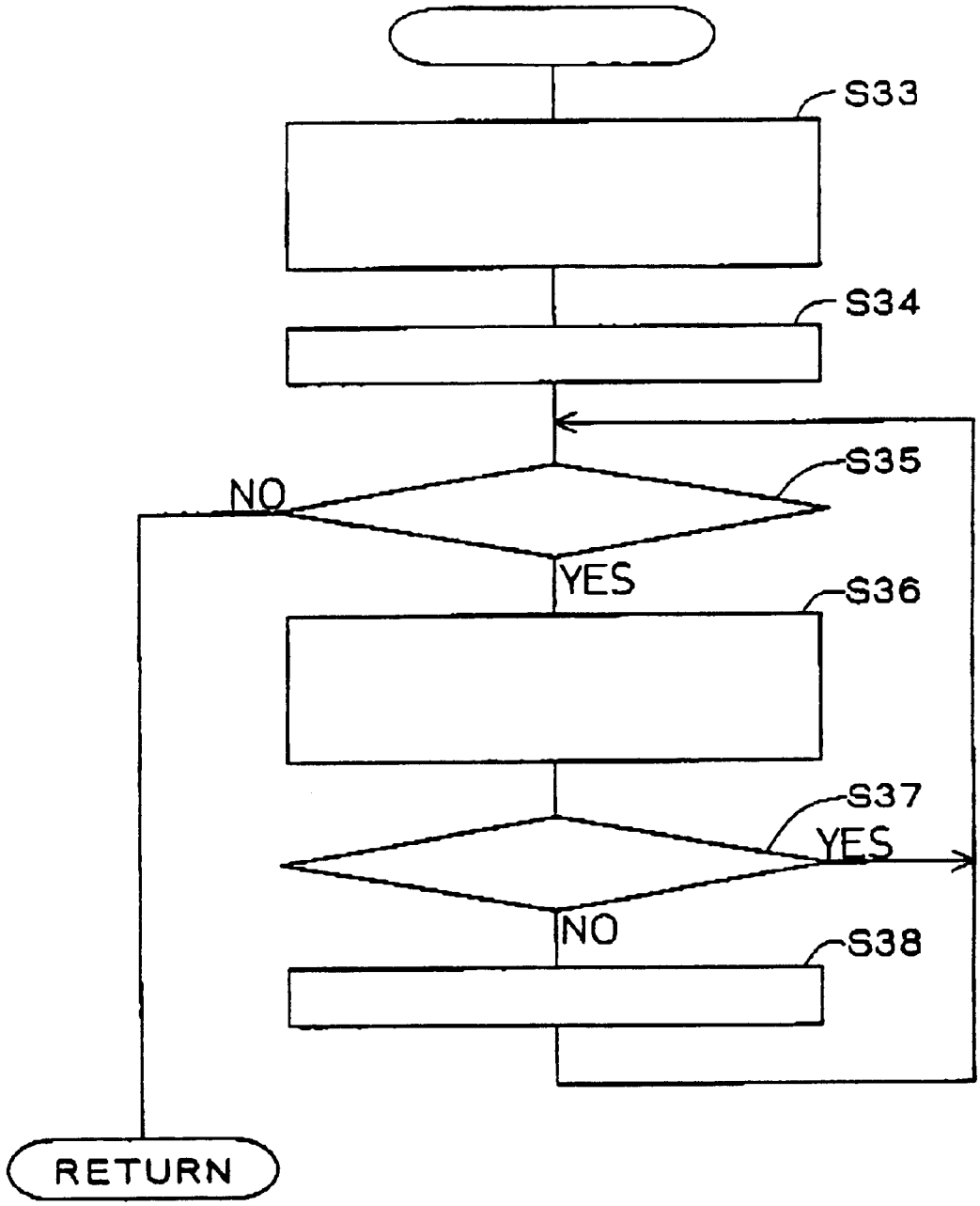
FIG. 19A is a flowchart showing demarcation line selection processing executed by the quilt designing apparatus, and FIG. 19B includes a summarized description of each step of the flowchart of FIG. 19A.

The control for a modification of a quilt design for such a case will be described with reference to flowcharts in FIGS. 18A and 19A. Summarized descriptions of each step of the flowcharts of FIGS. 18A and 19A are provided in FIGS. 18B and 19B, respectively. The design determining processing is basically the same as that of the embodiments described above, so that the same steps are given the same symbols and an explanation for the processing is omitted. Hereinafter, the quilt design modifying processing, which is different from that of the embodiment described above, is explained.

As shown in FIGS. 18A and 18B, when it is determined that the quilt design specified at S1 is not applicable to the paper piecing by the quilt design determining processing that includes S3 through S7 (S7-Y), first, the demarcation line selection processing (S13) is executed. In the demarcation line selection processing (S13), as shown in FIGS. 19A ad 19B, first, the demarcation lines that do not intersect other demarcation lines even when extended to the periphery and that divide the quilt design so that the number of the demarcation lines that exist in one of blocks divided by the extended demarcation line is less than the predetermined number, for example, less than 2, are selected (S33). The selected demarcation line data are stored in the cutting data memory 13*b* (S34). After that, a processing described below is executed on each selected demarcation line.

First, the quilt design is modified so that one piece can be separated from the quilt design by an extended demarcation line, by extending one of the selected demarcation lines to the periphery and deleting all demarcation lines that exist in one of blocks divided by the extended demarcation line. After that, a simulation is performed as to whether the modified quilt design is separable, by repeating the same processing as S3 through S7 (S36).

At this stage, it is determined whether the modified design can be separated into pieces until the last (S37). When all pieces cannot be separated, the processing is returned to S35 after deleting the selected demarcation line data which is stored at S34. When all pieces can be separated, the processing is straightly returned to S35. At S35, it is determined whether unconfirmed demarcation lines exist. When the unconfirmed determination lines exist (S35-Y), the same processing described above is executed on the unconfirmed selected demarcation lines. When a string of the processing is executed on all selected demarcation lines (S35-N), the demarcation line selection processing is finished.

By using the demarcation lines which are selected as described above, the quilt design can be modified so as to become applicable to the paper piecing, by extending the demarcation line and deleting all demarcation lines that exist in one of blocks divided by the extended demarcation line. The quilt designs are modified based on each selected demarcation line, and each modified quilt design is displayed on the CRT display 2 (S14), and then the processing is finished. Therefore, the operator can use any quilt design from the quilt designs displayed on the CRT display 2.

In each embodiment, as described above, the modified quilt design, that becomes applicable to paper piecing, is modified once, i.e., by extending one demarcation line, on the CRT display 2. It is to be understood that the invention is not restricted to the particular forms of the embodiment. All quilt designs that are modified so as to become applicable to paper piecing within a predetermined number of modifications or the number of modifications that is entered by an operator can be displayed. Further, when the quilt design cannot become applicable to the paper piecing by performing the modification once, a quilt design that becomes applicable to paper piecing by performing the modification twice can be displayed. Furthermore, when the quilt design cannot become applicable to the paper piecing by performing the modification twice, a quilt design that becomes applicable to the paper piecing by performing the modification thrice can be displayed. Moreover, the modified quilt design having the least number of modifications can be displayed on the CRT display 2, by selecting from a plurality of the modified quilt designs.

Figure 20A:
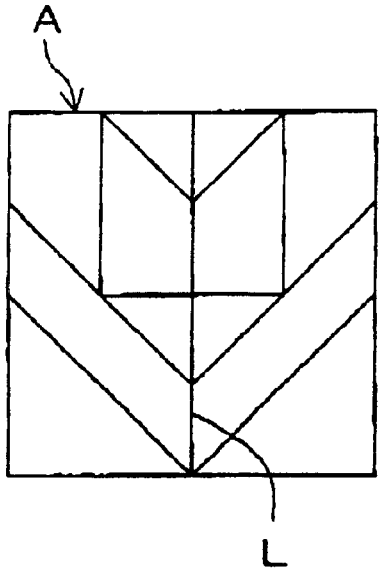
FIGS. 20A and 20B are diagrams for explaining a division of a quilt design into two.

In each embodiment described above, a quilt design is determined to not be applicable to the paper piecing when the all pieces cannot be finally separated by separating the pieces one after another by one demarcation line. For example, a quilt design A shown in FIG. 20A cannot be separated into pieces by separating pieces one after another by one demarcation line. Therefore, the quilt designing apparatus 1 determines that the design A is not applicable to the paper piecing.

Figure 20B:
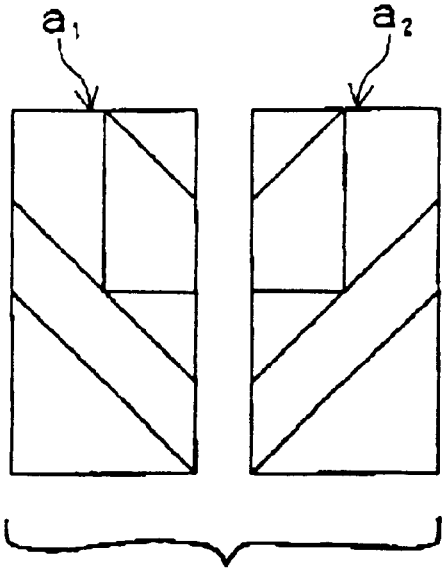

However, as shown in FIG. 20B, when the design A is divided into two blocks a1 and a2, that each include a plurality of pieces, by a demarcation line L, the blocks a1 and a2 can be separated into pieces by separating the pieces one after another by one demarcation line. Therefore, designs like the design A can be made by the paper piecing.

Therefore, when the quilt design can be divided into two blocks that include a plurality of pieces by one straight demarcation line even when the quilt design cannot be separated into pieces by one straight demarcation line in the design determining processing described above, the quilt designing apparatus 1 may be arranged so as to determine whether the design is applicable to paper piecing by determining whether all pieces of each block can be finally separated by separating pieces one after another by one straight demarcation line. As described above, in the design determining processing, the quilt designing apparatus 1 is arranged so as to be allowed to divide a quilt design into two blocks, so that the number of modifications can be minimized, and the quilt design can be modified with making the most of the original quilt design.

Further, in each embodiment described above, in the quilt design modifying processing, the quilt design is modified by extending any demarcation line, which satisfies a predetermined condition, and deleting all demarcation lines that exist in one of blocks divided by the extended demarcation line. It is to be understood that the invention is not restricted to such a modification method. The quilt design may be modified so that it is applicable to paper piecing by dividing the quilt design into two blocks by only extending any demarcation line which satisfies the predetermined condition. Also, both methods described above may be combined. As described above, when the quilt design is modified with consideration given to the division of the quilt design, the quilt design can be modified without deleting the demarcation lines. Also, the quilt design can be modified by restricting the demarcation lines to be deleted to a minimum number. Therefore, a modified quilt design that is similar to the original can be obtained.

When adopting a modification method wherein the division of the quilt design is taken into consideration, demarcation lines that divide the quilt design so that the quilt design will not be unseparable again are selected while predicting the condition after the division, and the quilt design is modified based on the demarcation lines selected by doing so. As a result, the quilt design modifying processing can be efficiently executed with a few number of modifications.

Figure 21:
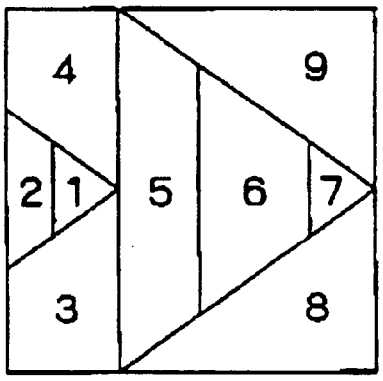
FIG. 21 is a diagram showing an example of a quilt design with piecing order to be used for quiltmaking.
Figure 22A:
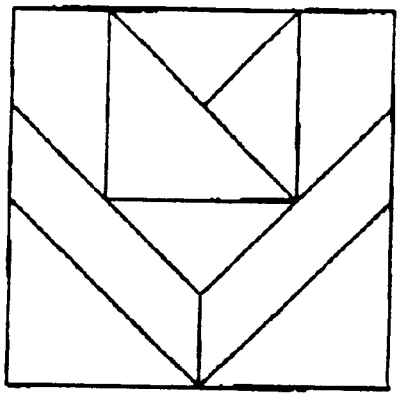
FIG. 22A is a diagram showing another example of a quilt design to be used for quiltmaking.
Figure 22B:
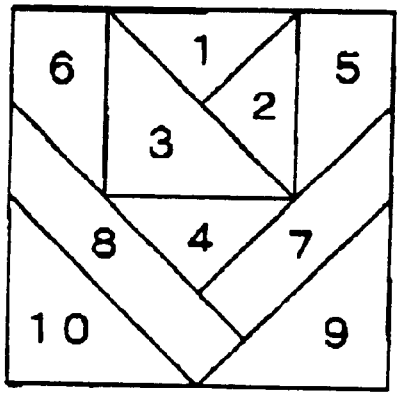
FIGS. 22B and 22C are diagrams showing examples of quilt designs with piecing order after modifying the quilt design of FIG. 22A.
Figure 22C:
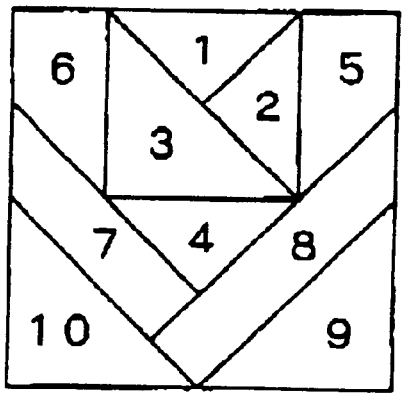

The quilt designing apparatus 1 may be arranged so as to store all piece information for each piece to be separated one after another when executing the quilt design determining processing, so that the piecing order can be obtained by arranging the piece information stored after the design determining processing, in inverse order. Therefore, a quilt design with piecing order as shown in FIG. 21 can be displayed on the CRT display 2.

Image data of a quilt design is read using an image scanner as quilt design data showing the quilt design. However, the quilt design data may be made by performing various image processing, such as vectorizing processing.

The quilt designing apparatus 1 is separately structured as a personal computer system. However, various modifications and alterations, such that the quilt designing apparatus 1 is structured as an integral hardware for quilt design modifying processing can be made thereto without departing from the scope of the invention.

What is claimed is:

1. A quilt designing apparatus, comprising:

a quilt design determiner that determines whether a quilt design is applicable to a predetermined piecing method for making a quilt based on quilt design data showing the quilt design that includes a plurality of pieces; and a quilt design modifier that modifies the quilt design so that the quilt design becomes applicable to the predetermined piecing method if the quilt design is determined as not being applicable to the predetermined piecing method by the quilt design determiner.

2. The quilt designing apparatus according to claim 1, wherein the quilt design determiner determines whether all pieces of the plurality of pieces are separated from the quilt design by separating the pieces one after another by one straight demarcation line.

3. The quilt designing apparatus according to claim 2, wherein the quilt design determiner determines that the quilt design is applicable to the predetermined piecing method if the quilt design can be divided into two blocks, that each includes a plurality of the pieces, by one straight demarcation line, even if the quilt design cannot be separated into pieces by one straight demarcation line.

4. The quilt designing apparatus according to claim 3, wherein the quilt design determiner includes a demarcation line analyzer that analyzes a property of the demarcation line separating adjacent pieces based on the quilt design data.

5. The quilt designing apparatus according to claim 3, wherein the quilt design modifier includes a demarcation line selector that selects a demarcation line that does not intersect another demarcation line even if the demarcation line is extended to a periphery and that divides the quilt design into two blocks when the demarcation line is extended to a periphery, at least one of the two blocks including a plurality of the pieces, even if the quilt design cannot be separated into pieces by one straight demarcation line, and the quilt design modifier extends the demarcation line, which is selected by the demarcation line selector, and modifies the quilt design by deleting each demarcation line that exists in one of blocks divided by the extended demarcation line.

6. The quilt designing apparatus according to claim 5, wherein the demarcation line selector selects a demarcation line that divides the quilt design so that a number of the demarcation lines, which exist in one of the two blocks divided by the demarcation line and are to be deleted by the quilt design modifier, is less then a predetermined number.

7. The quilt designing apparatus according to claim 5, wherein the demarcation line selector selects a demarcation line that divides the quilt design so that the quilt design cannot become unseparable again, with predicting a separating situation after the division by the selected demarcation line.

8. The quilt designing apparatus according to claim 1, wherein the quilt design determiner determines that the quilt design is applicable to the predetermined piecing method if the quilt design can be divided into two blocks that each includes a plurality of the pieces by one straight demarcation line, even if the quilt design cannot be separated into pieces by one straight demarcation line.

9. The quilt designing apparatus according to claim 2, wherein the quilt design modifier includes a demarcation line selector that selects a demarcation line that does not intersect another demarcation line even when the demarcation line is extended to a periphery and that divides the quilt design into two blocks if the demarcation line is extended to a periphery, at least one of the two blocks including a plurality of the pieces, even if the quilt design cannot be separated into pieces by one straight demarcation line, and the quilt design modifier extends the demarcation line, which is selected by the demarcation line selector, and modifies the quilt design by deleting each demarcation line that exists in one of blocks divided by the extended demarcation line.

10. A memory medium storing a quilt designing program, comprising:

a quilt design determining program that determines whether a quilt design is applicable to a predetermined piecing method for making a quilt based on quilt design data showing the quilt design that includes a plurality of pieces; and a quilt design modifying program that modifies the quilt design so that the quilt design becomes applicable to the predetermined piecing method if the quilt design is determined as not being applicable to the predetermined piecing method by the quilt design determiner.

11. A method of a quilt designing, the method being executed by a quilt designing apparatus that includes a quilt design determiner and a quilt design modifier, comprising steps of:

determining, with the quilt design determiner, whether a quilt design is applicable to a predetermined piecing method for making a quilt based on quilt design data showing the quilt design that includes a plurality of pieces; and modifying, with the quilt design modifier, the quilt design so that the quilt design becomes applicable to the predetermined piecing method if the quilt design is determined as not being applicable to the predetermined piecing method by the quilt design determiner.

* * * * *